United States Patent [19]

Milliman

[11] Patent Number: 4,616,622

[45] Date of Patent: Oct. 14, 1986

[54] PRESSURE-REGULATED GAS GUN

[75] Inventor: Keith Milliman, Fairport, N.Y.

[73] Assignee: The Coleman Company, Inc., Wichita, Kans.

[21] Appl. No.: 639,399

[22] Filed: Aug. 10, 1984

[51] Int. Cl.[4] ..... F41B 11/00

[52] U.S. Cl. ..... 124/73; 124/71; 124/76; 251/324

[58] Field of Search ..... 124/56, 60, 64, 71, 124/73, 74, 75, 76, 80; 251/324; 137/538; 48/191

[56] References Cited

U.S. PATENT DOCUMENTS

| | | | |
|---|---|---|---|
| 1,853,129 | 4/1932 | Lee | 137/538 |
| 2,123,324 | 7/1938 | Webby | 124/73 X |
| 2,635,599 | 4/1953 | Wells | 124/76 X |
| 3,212,489 | 10/1965 | Merz | 124/74 |
| 3,420,220 | 1/1969 | Ferrando | 124/71 |
| 3,717,947 | 2/1973 | Nomura | 124/73 X |
| 3,921,614 | 11/1975 | Fogelgren | 124/75 |
| 4,168,721 | 9/1979 | Mueller, Jr. | 137/538 X |
| 4,304,213 | 12/1981 | Jereckos | 124/69 |

*Primary Examiner*—Robert A. Hafer
*Assistant Examiner*—D. Neal Muir

[57] ABSTRACT

A gas gun includes a pressure regulator assembly which controls the velocity of projectiles fired by the gun by adjusting the pressure within the gas chamber of the gun. The regulator assembly includes a spring-biased piston which is slidable within a gas seal between a source of pressurized gas and the gas chamber. The piston is movable between a first position in which gas can flow from the source of pressurized gas to the gas chamber and a second position in which gas is prevented from flowing from the source of pressurized gas to the gas chamber. The force exerted on the piston by the spring can be adjusted to control the gas pressure at which the piston moves to its second position.

10 Claims, 6 Drawing Figures

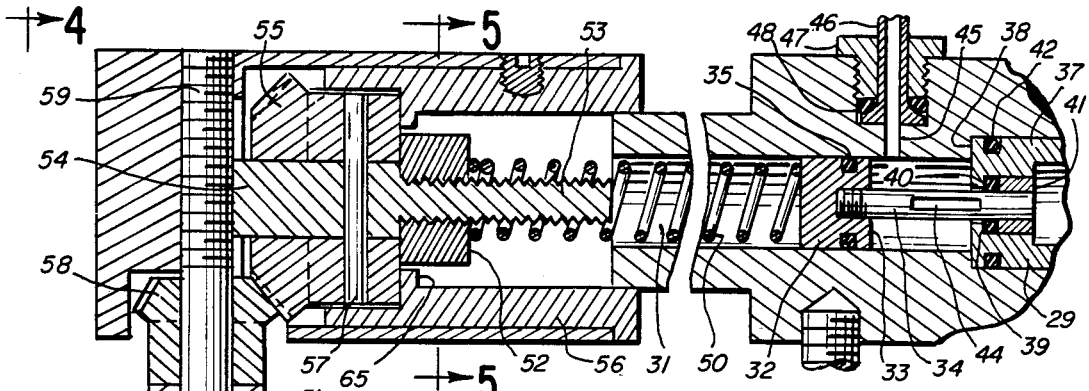
FIG. 3
FIG. 1a
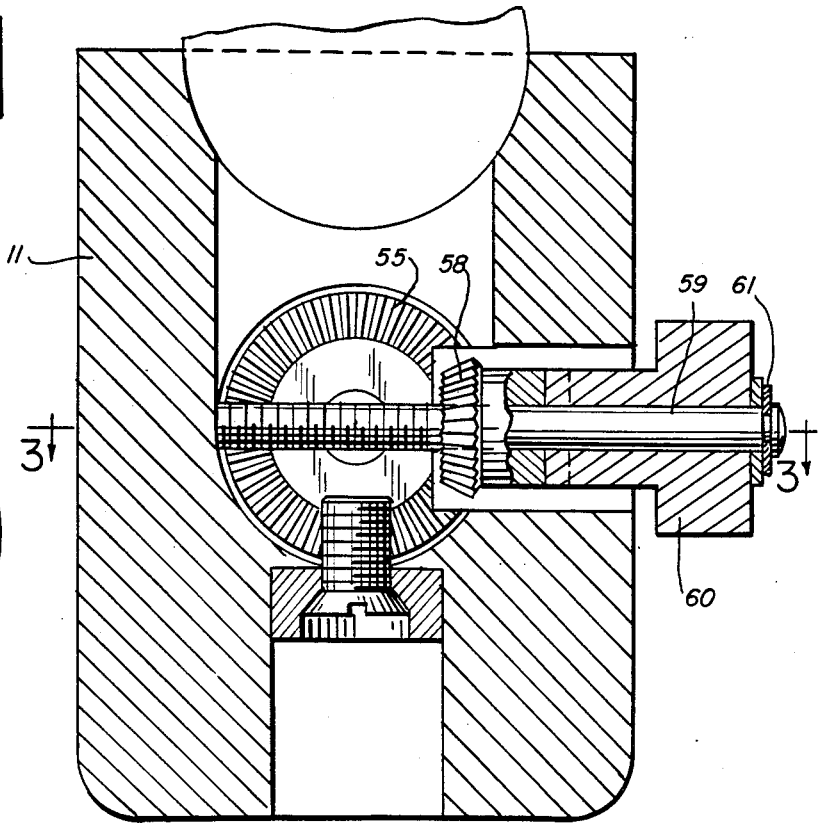
FIG. 2
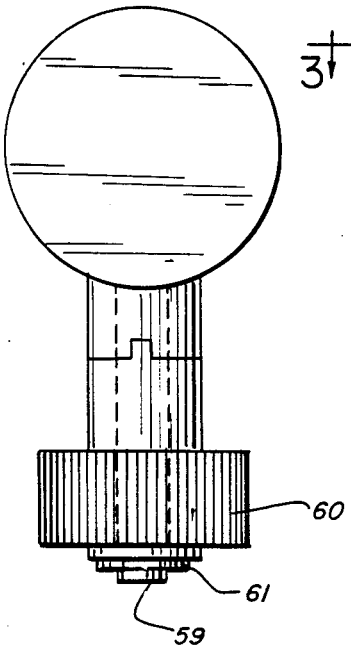
FIG. 4
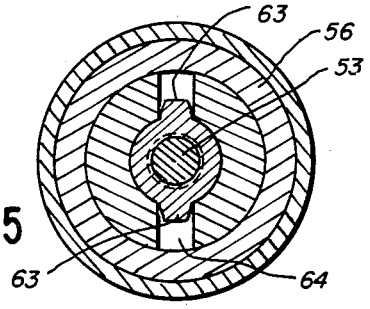
FIG. 5

PRESSURE-REGULATED GAS GUN

BACKGROUND AND SUMMARY

This invention relates to gas guns, and, more particularly, to a pressure regulator assembly for controlling the velocity of projectiles fired by the gun.

Gas guns such as $CO_2$ guns and air guns use pressurized gas to propel a projectile, for example, a BB or a pellet, from the gun. The pressurized gas is stored in a gas chamber in the gun, and when the gun is fired, a valve is opened to permit the pressurized gas to flow from the gas chamber to the barrel to propel the projectile.

The force which is exerted on the projectile can vary, for example, because of temperature variations, loss of pressure in the gas reservoir, or changes in the duration of valve opening. Variations in the force cause changes in the velocity of the projectile.

The invention provides a pressure regulating assembly which controls the velocity of the projectile by regulating the pressure within the gas chamber rather than by regulating the duration of valve opening. The regulator assembly includes a spring-biased piston which is slidable within a gas seal between the gas reservoir and the gas chamber. The piston permits pressurized gas to flow from the reservoir to the gas chamber until the pressure in the gas chamber which acts on the piston equalizes with the spring force on the piston. At that point the piston moves into sealing engagement with the gas seal. The regulator assembly will pressurize the gas chamber to the same pressure each time the gun is fired regardless of the temperature or pressure of the reservoir. The spring force on the piston can be varied as desired to adjust the pressure in the gas chamber and therefore the velocity of the projectile.

DESCRIPTION OF THE DRAWING

The invention will be explained in conjunction with an illustrative embodiment shown in the accompanying drawing, in which

FIG. 1*a* is an enlarged fragmentary sectional view of the regulator assembly of FIG. 1.

FIG. 2 is an enlarged fragmentary sectional view taken along the line 2—2 of FIG. 1;

FIG. 3 is a fragmentary sectional view taken along the line 3—3 of FIG. 2;

FIG. 4 is an end view taken along the line 4—4 of FIG. 3; and

FIG. 5 is a sectional view taken along the line 5—5 of FIG. 3.

DESCRIPTION OF SPECIFIC EMBODIMENT

Figure 1:
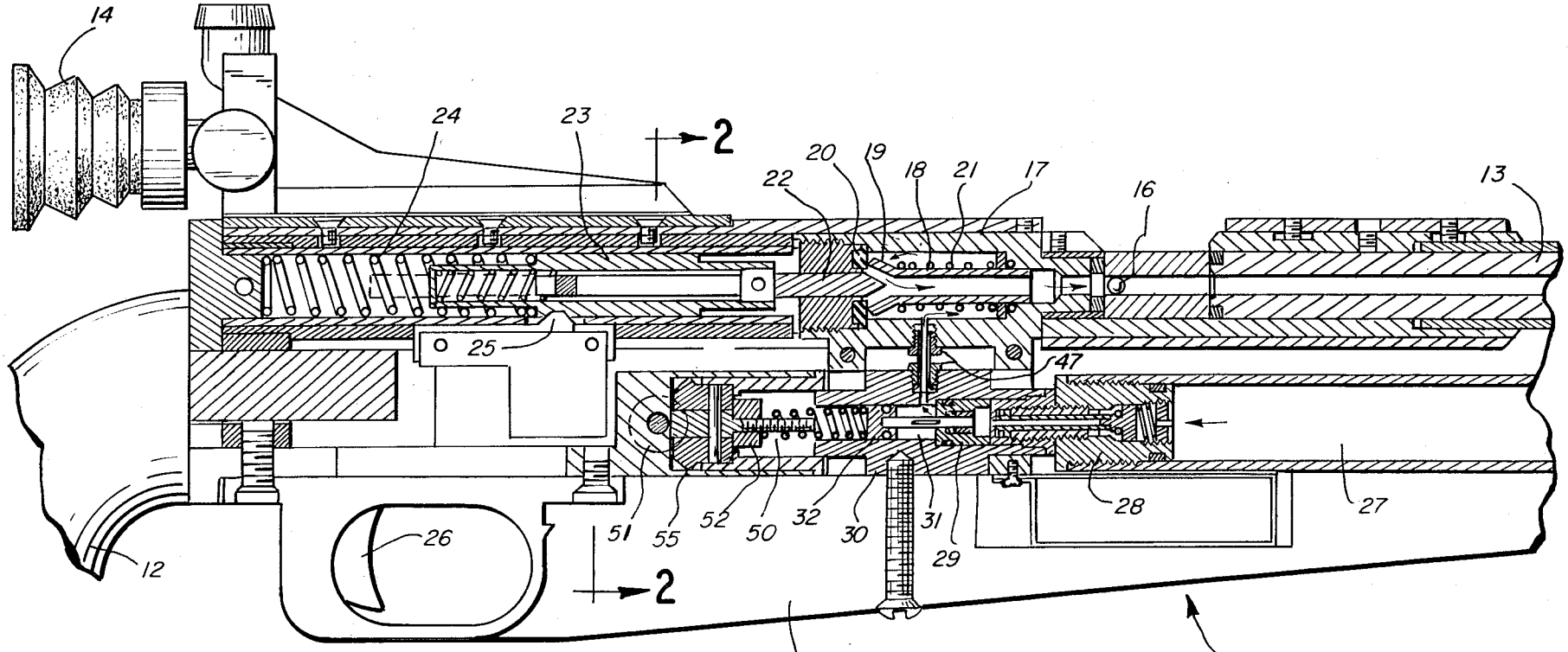
FIG. 1 is a fragmentary sectional view of a $CO_2$ gas gun equipped with a regulator assembly in accordance with the invention.

Referring first to FIG. 1, the numeral 10 designates generally a gas gun having a receiver 11, a stock 12, a barrel 13, and a sight 14. The particular gun illustrated is a $CO_2$ gas rifle. However, the invention can be used with pistols and other types of gas guns, for example, air guns.

A pellet 16 is positioned within the barrel 13 and can be propelled from the gun by pressurized gas which is contained within a valve housing 17 by a tubular valve 18. The valve 18 is slidably mounted within the valve housing, and the flared end 19 of the valve is forced against a sealing gasket 20 by a coil spring 21.

When the gun is fired, the tubular valve 18 is moved to the right away from the sealing gasket 20 by firing pin 22. The firing pin 22 engages an internal spider detent inside the tubular valve so that the pressurized gas can flow from the valve housing 17 through the flared end of the valve as illustrated by the arrows to propel the pellet through the barrel 13. The firing pin 22 and tubular valve 18 are conventional and well known in the art.

The firing pin 22 is driven to the right by a hammer 23 which is slidably mounted in the receiver and a coil spring 24. The gun is cocked by moving the hammer to the left to compress the coil spring 24, and the hammer is held in the cocked position by a sear 25. The sear is released by pulling trigger 26.

Pressurized $CO_2$ gas is supplied to the valve housing 17 by a gas reservoir 27 in the lower right portion of FIG. 1. A plug 28 is screwed into the left end of the gas reservoir, and pressurized gas can flow through a central bore in the plug to a sealing assembly 29.

The sealing assembly 29 is inserted into the right end of a piston housing 30 which has a central bore 31. A piston 32 includes a cylindrical piston head 33 (FIG. 2) which is slidable within the bore 31 and a piston shaft 34 which is screwed into the piston head. An O-ring 35 in an annular groove in the piston head provides a gas-type seal between the piston head and the wall of the bore 31.

The seal assembly 29 includes an annular seal housing 37 which butts against a shoulder 38 in the bore 31 and an O-ring or sealing gasket 39 which is held against a shoulder 40 in the sealed housing by a threaded sleeve 41. The piston shaft 34 extends through the O-ring 39, and the piston shaft and the O-ring prevent pressurized gas from passing through the seal assembly when the piston shaft is in the position shown in FIG. 2. An O-ring 42 provides a seal between the seal housing 37 and the piston housing 30.

An elongated slot 44 extends transversely through the piston shaft 34. When the right end of the slot passes to the right of the O-ring 39, gas can flow through the slot into the bore 31 of the piston housing 30. Gas in the bore 31 flows through a port 45 in the piston housing, through a tube 46, and into the valve housing 17 (FIG. 1). Each end of the tube 46 is sealingly connected to the piston housing or to the valve housing by a threaded plug 47 and an O-ring 48. The portion of the bore 31 of the piston housing between the piston head 32 and the gas seal 39, the bore of the valve housing 17 outside of the tubular housing 18, and the connecting tube 46 provide a gas chamber for the charge of pressurized gas which propels the pellet when the gun is fired.

The functional equivalent of the slot 44 can be provided by a reduction in the diameter of the piston shaft 34 in the area where the slot 44 is located. If the reduction in the diameter can be accomplished by a reduced-diameter cylindrical portion, a flat on one or more sides of the shaft, a series of axially extending grooves on the outside surface of the shaft, or the like.

A coil spring 50 resiliently biases the piston head 32 toward the gas seal 39. The force which the spring exerts on the piston head is adjusted by an adjusting assembly 51.

The left end of the spring butts against a spring stop 52. The spring stop has an internally threaded bore which is threadedly engaged with an elongated screw 53 which extends into the spring 50. The screw 53 includes an elongated unthreaded shank 54 which extends into a bore in a bevel gear 55. The bevel gear 55 rotates within gear housing 56, and the bevel gear and the screw 53 are secured for common rotation by a pin 57.

A second bevel gear 58 is rotatably mounted on a shaft 59 and meshes with the gear 55. The gear 58 is turned by a knurled knob 60 which is held on the shaft 59 by a D ring 61.

Referring to FIG. 5, the spring stop 52 includes two radially extending ribs 63. A slot 64 in piston body 30 contains the ribs 63 and prevents rotation of the spring stop 52 when screw 53 is rotated. Accordingly, rotation of the screw 53 causes the spring stop to travel axially along the screw.

FIGS. 1 and 2 show the gun in a ready-to-fire condition in which the gas chamber provided by the valve housing 17 and the piston housing 30 is filled with pressurized gas. The pressure of the gas in the piston housing acting against the right side of the piston head 33 holds the piston head against the force exerted by the regulator spring 50 so that slot 44 in the piston shaft 34 is to the left of the O-ring 39 in the sealing assembly 29. The pressure in the gas chamber can be increased by rotating the knob 60 to move the spring stop 52 to the right, thereby increasing the spring force on the piston head 33. The piston head and piston shaft will move to the right, and when the slot 44 passes the O-ring 39, pressurized gas from the reservoir 27 will move through the slot and act on the piston head. When the pressure on the piston head equalizes with the spring force, the slot 44 will move to the left of the O-ring and seal the gas chamber from the reservoir. When the gun is fired, the tubular valve 18 is forced to the right, allowing the pressurized gas in the gas chamber to propel the pellet 16. The valve spring 21 will close the valve after the gas charge leaves the gas chamber. As the pressure in the gas chamber is reduced, the piston head 33 is forced to the right by the regulator spring 50. Pressurized gas will then flow from the reservoir 27 through the slot 44 of the piston shaft to refill the gas chamber. The regulator spring 50 ensures that the gas chamber will be filled to the same pressure each time the gun is fired regardless of the pressure in the reservoir or the temperature of the reservoir. For example, a new $CO_2$ cartridge will pressurize the reservoir to about 850 psi at 70° F. If the regulator assembly is adjusted to fill the gas chamber to 600 psi, the gas chamber will always be filled with 600 psi as long as the pressure in the reservoir is above 600 psi even though the pressure in the reservoir is reduced each time the gas chamber is filled. The pressure of 600 psi will provide a pellet velocity of about 600 feet per second. The pellet velocity can be adjusted as desired simply by rotating the adjusting knob 60 to increase or decrease the spring force on the piston head.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. In a gas gun having a source of pressureized gas and a gas chamber for storing pressurized gas for propelling a projectile from the gun, a pressure regulator assembly comprising:

(a) valve means between the source of pressurized gas and the gas chamber for permitting gas to flow from the source of pressurized gas to the gas chamber until the pressure of the gas in the gas chamber reaches a predetermined level, the valve means including a gas seal between the source of pressurized gas and the gas chamber and a piston slidably movable in the seal between a first position in which pressurized gas can flow from the source of pressurized gas to the gas chamber and a second position in which gas flow between the source of pressurized gas in the gas chamber is prevented; and (b) valve-adjusting means for adjusting the predetermined level of the pressure of the gas in the gas chamber, the valve-adjusting means including a spring resiliently biasing the piston toward its first position, a knob rotatably mounted on the exterior of the gun, a first gear attached to the knob for rotation therewith, a second gear meshing with first gear for rotation therewith, a screw attached to the second gear for rotation therewith, and a spring stop threadedly mounted on the screw for axial movement therealong, the spring stop engaging said spring whereby axial movement of the spring stop on the screw adjusts the compression of the spring.

2. The structure of claim 1 in which a slot extends transversely through the piston, the slot extending on both sides of the gas seal when the piston is in its first position whereby gas can flow from the source of pressuzied gas through the slot and into the gas chamber.

3. The structure of claim 1 in which the piston includes a piston head which is slidable within a bore in the gun, seal means on the piston head sealingly engaging the wall of the bore, and a piston shaft extending from the piston head through the gas seal.

4. The structure of claim 3 in which the gas seal is an O-ring and the piston shaft extends slidably through the O-ring.

5. The structure of claim 4 in which a slot extends transversely through the piston shaft, the slot extending on both sides of the gas seal when the piston is in its first position whereby gas can flow from the source of pressurized gas through the slot and into the gas chamber.

6. In a gas gun having a reservoir of pressurized gas and a gas chamber for storing pressurized gas for propelling a projectile from the gun, a pressure regulator assembly comprising:

(a) a piston housing having an elongated bore, (b) a gas seal housing mounted within said bore and a gas seal mounted within the gas seal housing, the gas seal being between the reservoir and the gas chamber;

(c) a piston having a piston head slidably mounted within said bore and a piston shaft extending from the piston head through the gas seal, the portion of said bore between the piston head and the gas seal forming a portion of said gas chamber, the piston housing having a port for permitting gas to flow from the bore to the remainder of the gas chamber;

(d) a coil spring within said bore engaging the piston head and resiliently urging the piston head toward the gas seal, the piston head being slidable between a fired position adjacent the gas seal and a ready-to-fire position farther away from the gas seal;

(e) valve-adjusting means for adjusting the compression of the coil spring; and (f) means on the piston shaft for permitting gas flow from the reservoir to the gas chamber when the piston housing is in the fired positon or between the fired position and the ready-to-fire position.

7. The structure of claim 6 in which said means on the piston shaft for permitting gas flow is provided by a slot which extends transversely through the shaft.

8. The structure of claim 7 in which said slot extends from one side of the gas seal to the other when the piston head is in the fired position or between the fired position and the ready-to-fire position.

9. The structure of claim 6 in which the gas seal is an O-ring which surrounds the piston shaft.

10. The structure of claim 6 in which the valve-adjusting means includes a knob rotatably mounted on the exterior of the gun, a first gear attached to the knob for rotation therewith, a second gear meshing with first gear for rotation therewith, a screw attached to the second gear for rotation therewith, a spring stop threadedly mounted on the screw for axial movement there along, the spring stop engaging said spring whereby axial movement of the spring stop on the screw adjusts the compression of the spring.

* * * * *